US006436240B1

(12) United States Patent
Jeffrey

(10) Patent No.: US 6,436,240 B1
(45) Date of Patent: Aug. 20, 2002

(54) PAPERMACHINE CLOTHING

(75) Inventor: John Jeffrey, Blackburn (GB)

(73) Assignee: Voith Fabrics Heidenheim GmbH & Co. KG, Heidenheim (DE)

( * ) Notice: Subject to any disclaimer, the term of this patent is extended or adjusted under 35 U.S.C. 154(b) by 0 days.

(21) Appl. No.: 09/445,427

(22) PCT Filed: Jun. 10, 1998

(86) PCT No.: PCT/GB98/01544

§ 371 (c)(1),
(2), (4) Date: Mar. 3, 2000

(87) PCT Pub. No.: WO98/56982

PCT Pub. Date: Dec. 17, 1998

(30) Foreign Application Priority Data

Jun. 12, 1997 (GB) ..... 9712113

(51) Int. Cl.[7] ..... D21F 7/08

(52) U.S. Cl. ..... 162/358.2; 162/900; 162/903; 442/32

(58) Field of Search ..... 162/348, 358.2, 162/900, 902, 903; 442/32; 428/217

(56) References Cited

U.S. PATENT DOCUMENTS

| | | | | | |
|---|---|---|---|---|---|
| 1,536,533 | A | * | 5/1925 | Sheehan | 162/358.2 |
| 4,206,258 | A | * | 6/1980 | Balcar | 162/900 |
| 4,427,734 | A | * | 1/1984 | Johnson | 162/900 |
| 4,482,430 | A | | 11/1984 | Majaniemi | 162/358 |
| 4,541,895 | A | | 9/1985 | Albert | 162/348 |
| 4,908,103 | A | * | 3/1990 | Cronin | 162/358.4 |

FOREIGN PATENT DOCUMENTS

| | | |
|---|---|---|
| EP | 0 576 115 | 12/1993 |
| GB | 2 254 288 | 10/1992 |
| WO | 92/17643 | 10/1992 |

* cited by examiner

*Primary Examiner*—Karen M. Hastings
(74) *Attorney, Agent, or Firm*—Caesar, Rivise, Bernstein, Cohen & Pokotilow, Ltd.

(57) ABSTRACT

Papermachine clothing comprises a base fabric comprising at least two superimposed perforated non-woven membranes (11, 12), the upper or paper side one of which (11), has a lower maximum creep modulus and is less hard than the lower or machine side membrane (12).

8 Claims, 1 Drawing Sheet

PAPERMACHINE CLOTHING

This invention relates to papermachine clothing, particularly, but not exclusively to clothing for use in the press section of a papermaking machine.

WO 92/17643 discloses papermachine clothing of the kind for use in the press sections of a papermaking machine which includes a base fabric composed of superimposed layers of synthetic thermoplastics material in mesh form which are secured together. The superimposed layers have apertures of different respective sizes and the base fabric formed by the superimposed layers provides support and reinforcement to a fibrous batt. The lower (machine contacting) layer may have a coarser mesh than the upper (batt contacting) layer.

It has been found that when resilient membranes are used, as at present, in such structures, the flexibility of the material under the pressures exerted in press nip causes the membrane material to deform and thus reduce or even close the mesh apertures. This in turn creates problems with re-wetting of the paper web with water which has entered the mesh being squeezed back through the batt into paper from which it has previously been extracted.

An object of the invention is to provide papermachine clothing with improved dimensional stability and strength, whereby the tendency towards closure of mesh apertures under nip pressure is much reduced and rewetting, and marking, of the paper web alleviated.

In accordance with the invention, papermachine clothing includes a base fabric comprised of at least two superposed membrane layers of synthetic thermoplastics material in mesh form, characterised in that the lower (machine side) membrane layer consists of a harder material than the upper (paper side) membrane layer which has a lower maximum creep modulus than the lower membrane layer.

Preferably, said upper membrane layer is of a thermoplastic polyurethane matrix material, with a Shore A hardness of, for example, between 65 and 85. The lower membrane preferably comprises a polyamide matrix material with a Shore D hardness of, for example, between 40 and 45.

A sandwich layer of batt staple fibre may be provided between the membrane layers.

The base fabric will normally in use support a fibrous batt of known form and materials, for example as described in WO 92/17643.

The effect of using a very hard lower membrane as envisaged is to create a large number of pockets into which water expelled from the paper sheet can be accepted. This can significantly increase the dewatering capacity of the felt.

The base fabric may of course be composed of three or more superimposed layers of perforated membrane and these may increase in hardness from the uppermost to the lowermost layer and similarly the sizes of the apertures may increase from the uppermost to the lowermost layer. Preferably at least one membrane layer contains parallel reinforcing yarns extending in at least one direction, and the fabric may comprise two such layers. These membranes may be made in accordance with GB-A-2254288. The base fabric may contain one or more woven base cloth layers either between or on an outer face of the membrane layers.

BRIEF DESCRIPTION OF THE DRAWINGS

Embodiments of the invention will now be described by way of example only, with reference to the accompanying drawings, wherein.

DETAILED DESCRIPTION

Figure 1:
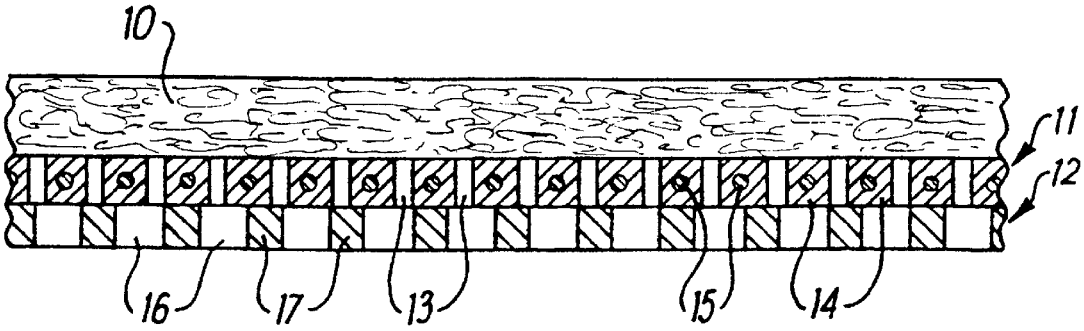
FIG. 1 is a cross-section of a first embodiment of papermachine clothing according to the invention.

Referring first to FIG. 1, a first embodiment of papermachine clothing according to the invention comprises a fibrous batt 10 of known type supported by a base fabric which is composed of two superimposed membrane layers, an upper layer 11 and a lower layer 12.

The upper layer 11 is of a thermoplastic matrix material such as a thermoplastic elastomer, e.g. thermoplastic polyurethane with a Shore A hardness of from 65–85. The layer 11 is in the form of a mesh grid having substantially square or rectangular apertures 13 defined between machine direction lands 14 and cross machine direction strips not shown. In accordance with the teaching of WO 92/17643, at least some of the machine direction lands 14 are reinforced with load bearing yarns 15 embedded in and extending along the lands 14.

The lower layer 12 is secured to the upper layer 11 by thermal fusion of the abutting surfaces, or by means of an appropriate adhesive or by ultrasonic welding or needling. The lower layer 12 is of a thermoplastic material, e.g. a polyester, silicone or nylon such as PA6, PA6.6 or PA6.10 or a blend containing one or more of these. This material has a Shore D hardness of 40–45. The Shore D scale is used for this as the values available on the Shore A scale do not go high enough to provide a range for the layer 12.

Layer 12 is similar in configuration to layer 11 and also comprises square or rectangular apertures 16 defined by machine direction lands 17 and cross machine direction lands (not shown) to produce a similar mesh or reticulate structure. However, the apertures 16 are longer in size than the apertures 13 in the upper layer 11.

By way of example, the layer 11 may be from 0.75–1.25 mm in thickness, the apertures 13 have an individual means area of from 0.6–1.2 $mm^2$ and a pitch (centre to centre spacing of the apertures 13) of from 1.25 to 1.75 mm. The corresponding dimensions of the lower layer 12 are: thickness in the range 0.5–1.0 mm, mesh apertures 16 mean area from 1.21–1.8 $mm^2$ and pitch in the range of 1.75 mm–2.25 mm. In other words, the lower layer is much harder than the upper layer, somewhat thinner, with larger more widely spaced apertures.

Figure 2:
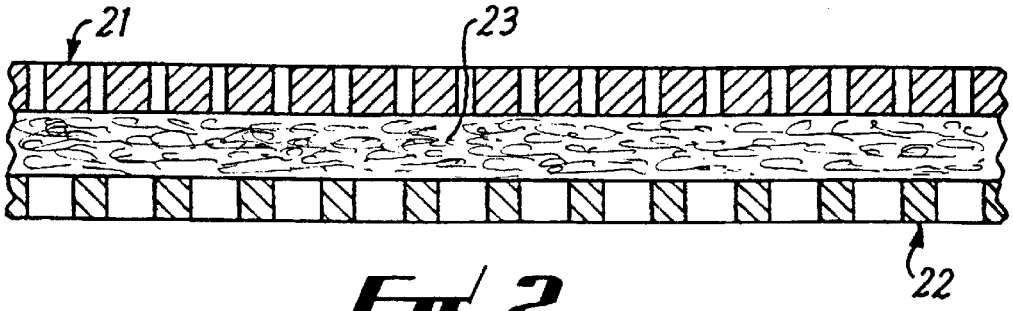
FIG. 2 is a cross-section of a second embodiment of papermachine clothing according to the invention.

FIG. 2 is a variant of FIG. 1 wherein an upper layer 21 is separated from a lower layer 22 by a batt layer 23. The upper and lower layers have similar dimensions to layers 11 and 12 in FIG. 1 and their properties and materials are also the same as or similar to those respective layers 11, 12. The batt layer 23 is needled into the lower membrane layers 22 and then the upper membrane layer 21 is placed on top of the batt layer and the entire structure is needled together to effect a bond between the layers.

Figure 3:
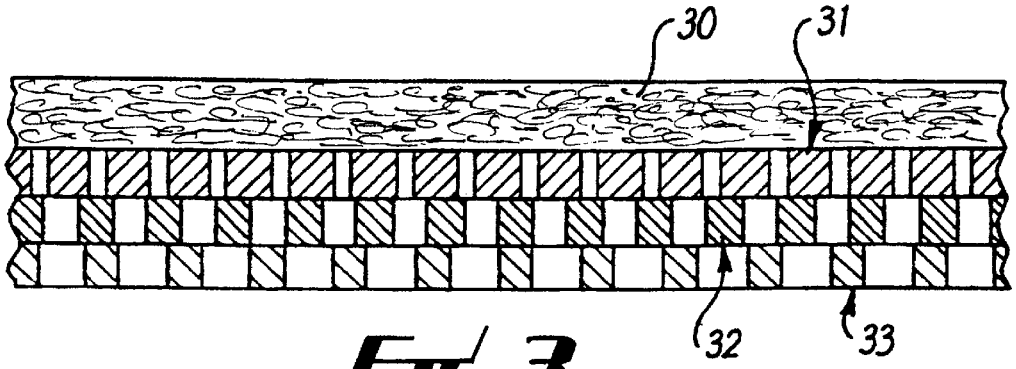
FIG. 3 is a cross-section of a third embodiment of papermachine clothing according to the invention.

In FIG. 3 is shown a further variant, wherein papermachine clothing comprises an upper batt layer 30, supported by a base fabric comprised of three superimposed layers 31, 32, 33. Upper layer 31 and lower layer 33 have the same or similar properties and materials to those of layers 11 and 12 respectively of FIG. 1. Intermediate layer has hardness and dimensional properties which are intermediate between those of layers 31 and 33. This may be achieved by choosing an appropriate plastics material such as a polyamide/polyurethane blend or a less plasticised polyurethane.

Flexibility may be determined by meaning the converse, i.e. stiffness as defined by maximum creep modulus. This is measured at 120° C. and under 0.13 MPa applied load. The creep modulus of the softer layers 11, 21, 31 in the above embodiments may be in the range 2–10 MPa, and the harder layers 12, 22, 33 may be in the layer 15–25 MPa. The intermediate layer 32 of FIG. 3 may have an intermediate value of e.g. 8–16 MPa.

The above embodiments are described by way of example only and the invention includes a variety of other embodiments within its scope. For example, any suitable combination of relatively resilient and relatively hard materials may be used, including metals for the hard membrane and natural or synthetic rubber as well as other plastics.

Any form of mesh of perforated sheet or foraminous structure may be used with any desired shape of aperture, including honeycomb structures and sheets with circular apertures, metal or plastics wire grids and meshes and the like.

What is claimed is:

1. Paper machine clothing including a base fabric comprising at least two superposed perforated non-woven membrane layers of material in mesh form, characterised in that the lower (machine side) membrane layer consists of a harder material than the upper (paper side) membrane layer, which has a lower maximum creep modulus than the lower membrane layer, wherein said upper membrane layer is a thermoplastic polyurethane matrix material that has a Shore A hardness of between 65 and 85 and wherein said lower membrane comprises a polyamide matrix material with a Shore D hardness of between 40 and 45.

2. Papermachine clothing according to claim 1, wherein a sandwich layer of batt staple fibre is provided between the membrane layers.

3. Papermachine clothing according to claim 1, comprising three or more superimposed layers of perforated membrane, said layers being arranged in order of increasing maximum creep modulus from the uppermost layer to the lowermost layer.

4. Papermachine clothing according to claim 1, wherein at least one of said membrane layers comprises parallel reinforcing yarns extending in at least one direction.

5. Papermachine clothing according to claim 1, wherein said base fabric supports a fibrous batt layer.

6. Papermachine clothing according to claim 1, wherein the base fabric includes one or more woven layers between or on an outer face of the membrane layers.

7. Papermachine clothing according to claim 1, wherein the harder, membrane layer of higher maximum creep modulus comprises a perforated member having apertures or perforations of larger size and more widely spaced than corresponding apertures in the upper softer membrane layer of lower maximum creep modulus which is also a mesh or perforated member.

8. Papermachine clothing according to claim 1, wherein the softer membrane layer has a maximum creep modulus of from 2–10 MPa, and the harder membrane layer has a maximum creep modulus of from 15–25 MPa.

* * * * *